United States Patent [19]

Heimo

[11] 4,337,505

[45] Jun. 29, 1982

[54] HOLDER FOR LIGHT-TRANSMISSIVE PICTURES

[76] Inventor: Ernest Heimo, Chemin de beau Rivage 10, 1000 Lausanne, Switzerland

[21] Appl. No.: 116,643

[22] Filed: Jan. 29, 1980

[30] Foreign Application Priority Data

| | | | |
|---|---|---|---|
| Feb. 2, 1979 | [DE] | Fed. Rep. of Germany | 7902832[U] |
| Sep. 15, 1979 | [DE] | Fed. Rep. of Germany | 7926218[U] |
| Oct. 30, 1979 | [DE] | Fed. Rep. of Germany | 7930651[U] |

[51] Int. Cl.[3] ..... A47F 11/10

[52] U.S. Cl. ..... 362/125; 362/252; 362/352; 362/806

[58] Field of Search ..... 362/125, 252, 351.2, 362/806

[56] References Cited

U.S. PATENT DOCUMENTS

| | | | |
|---|---|---|---|
| 2,177,204 | 10/1939 | Buzick et al. | 362/351 X |
| 3,000,774 | 9/1961 | Swedlow et al. | 362/806 X |
| 3,895,229 | 7/1975 | Strom | 362/351 |
| 4,163,998 | 8/1979 | Anderson et al. | 362/252 X |
| 4,165,529 | 8/1979 | Hagelthorn | 362/352 |
| 4,212,052 | 7/1980 | Chambard | 362/352 |

*Primary Examiner*—Peter A. Nelson

*Attorney, Agent, or Firm*—Max Fogiel

[57] ABSTRACT

A holder for light-transmissive pictures in which light-transmissive pictures are arranged between a first curved foil of elastic light-transmissive material, and a second foil of elastic transparent or translucent material which is sprung into the curvature of the first foil. Bent-together ends of the first foil and the second foil have overlapping cutouts through which means for connecting the two ends may be inserted.

17 Claims, 7 Drawing Figures

HOLDER FOR LIGHT-TRANSMISSIVE PICTURES

BACKGROUND OF THE INVENTION

The invention relates to a holder for light-transmissive pictures, consisting of a first curved foil of elastic light-transmissive or transparent material and a second foil of elastic light-transmissive or transparent material which is sprung into the arcuate curvature and abuts the first foil, the translucent pictures being arranged between the first foil and the second foil.

Photographs and other pictures are reproduced in constantly increasing frequency on light-transmissive material, particularly on light-transmissive synthetic plastic foils. Such light-transmissive pictures can be viewed not only in incident light, but also in light passing through them.

From German Gebrauchsmuster No. 76 40 586 a holder for light-transmissive is known in which the pictures may remain permanently but yet be replaceable. Such a holder for light-transmissive pictures consists of a curved transparent pane and a foil of elastic transparent or translucent material which is sprung into the curvature and engages the pane; the transparent pictures are arranged between the pane and the foil. The pane consists of a transparent material, preferably of an elastic synthetic plastic which is bendable and two opposite sides of which can be bent together and connected with one another. In this manner it is achieved that the pane of transparent material can be bent to assume the form of a lamp shade and can be used as a lamp shade.

In connecting such a holder for transparent pictures it has been found to be cumbersome and difficult to bend the opposite sides of the elastic foil together, and particularly to connect them with one another. For the connection of the two opposite sides a separate working step is required, which consists in that the two opposite sides must, after bending together, be adhered to each other, screwed to each other, withered to each other, sewed to each other or similarly connected.

SUMMARY OF THE INVENTION

The purpose of the present invention is to provide a holder of the type mentioned in the beginning for transparent pictures, in which no separate operating step is required for connecting the bent-together opposite sides of the elastic pane.

This task is solved essentially in a holder of the type mentioned in the beginning, in that the bent together ends of the first foil and the second foil overlap one another and the overlapping bent-together ends of the first foil and of the second foil have cutouts which overlie one another and through which means for connecting the two ends extend.

In a most advantageous embodiment of the invention the means for connecting are a lamp socket which extends through the superimposed cutouts in the first and the second foil and as they are connected. The cable part is located outside the holder whereas the bulb part is within the holder. The cross-section of the cutouts in the first and the second foil must be correspondingly large. If a lamp socket is used the cable part and the bulb part of which have at their juxtaposed ends circumferential flanges, then the edge portion of the cutouts is clamped between the two flanges for connecting the overlap ends. The one flange, particularly the flange on the bulb part, should be a ring, particularly a threaded-on ring, placed onto the bulb part.

The lamp sockets are generally supplied by the manufacturer in prefabricated condition. To assemble the holder it is thus necessary only to unscrew the flange which is constructed as a ring from the bulb part, to bend together the opposite ends of the foils having the cutouts, until the cutouts in the two ends overlap one another, to place the lamp sockets from the exterior through the cutouts and to thread the ring-shaped flange back onto the bulb part until the edge portions of the cutouts are clamped between the flanges on the bulb part and the cable part. Thereupon the bulb can be screwed in place. The prefabricated lamp socket should directly be provided with a connecting cable with socket and preferably with a switch.

The spacing of the cutouts in the outer first foil must, according to the larger radius, be slightly greater than the spacing of the cutouts in the inner second foil.

It is possible to provide the flanges and the overlapping ends of the foil with two or more juxtaposed holes through which bolts can be extended.

In a very advantageous embodiment of the invention the first foil and the second foil are provided with juxtaposable cutouts which are arranged in a number and a spacing from one another corresponding to the number and spacing of the contact pins of a light connector and in which the holder is provided beneath the cutouts with a lamp socket having connecting pins and at the exterior there is located a plug into the female recesses of which the plug contacts extend through the cutouts in the foils. In the region of the foils the contacts or pins are then preferably provided with an insulating layer on them, or else annular insulating elements extend around the female recesses and also through the foils. In the wall of the recesses or on the pins a projecting springy element should be arranged which engages into a depression of the contact pins respectively in the walls of the recesses. In this manner, a very secure plug connection is obtained between the lamp socket and the connector. Of course it is possible to provide the lamp socket with recesses and the connector with the pins.

To facilitate the exchange of pictures placed between the two foils it is possible to provide the cutouts for the lamp socket in the overlapping ends of the inner second foil of a cross-section corresponding to the cross-section of the flange on the bulb part.

The opposite ends of the holder bent from the first foil and the second foil may be provided with rings, preferably of a U-shaped profile, into which the lateral ends of the holder are inserted. The ends of this U-shaped profile should overlap one another. These rings are advantageously made of an elastic material, particularly metallic, primarily synthetic plastic, preferably coated synthetic plastic.

To facilitate the assembly it is further possible to connect the first foil and the second foil at one of the opposite ends provided with cutouts, preferably by means of a U-shaped connector which clamps the two ends of the foils between its legs. This connector should be of an elastic material, especially synthetic plastic, preferably coated synthetic plastic.

The first foil should be of transparent material and the second foil of translucent material. Particularly suitable are elastic materials, primarily synthetic plastics.

Further characteristics of the invention are set forth in the description of the Figures and in the dependent claims, and it is noted that all individual characteristics and all combinations of individual characteristics are essential for the invention.

BRIEF DESCRIPTION OF THE DRAWINGS

FIG. 1 diagrammatically shows an inventive holder in perspective view,

FIG. 2 is a plan view of the cut foils with the cutouts for the lamp socket,

FIG. 3 shows diagrammatically a vertical section parallel to the longitudinal axis through a picture holder according to FIG. 1 with a lamp socket having a flange threaded onto the bulb part, FIG. 4 is a section similar to FIG. 1, whereby the flanges on the bulb part and cable part are connected with one another by bolts, FIG. 5 is a plan view of a fragment of the bent-together foils with cutouts for the lamp socket and holes for the bolts, FIG. 6 is a section like FIG. 1, whereby bulb part and lamp part are connected with one another via a plug connection and FIG. 7 shows the engagement of a connecting pin into a recess in a holder according to FIG. 6.

DESCRIPTION OF THE PREFERRED EMBODIMENTS

Figure 1:
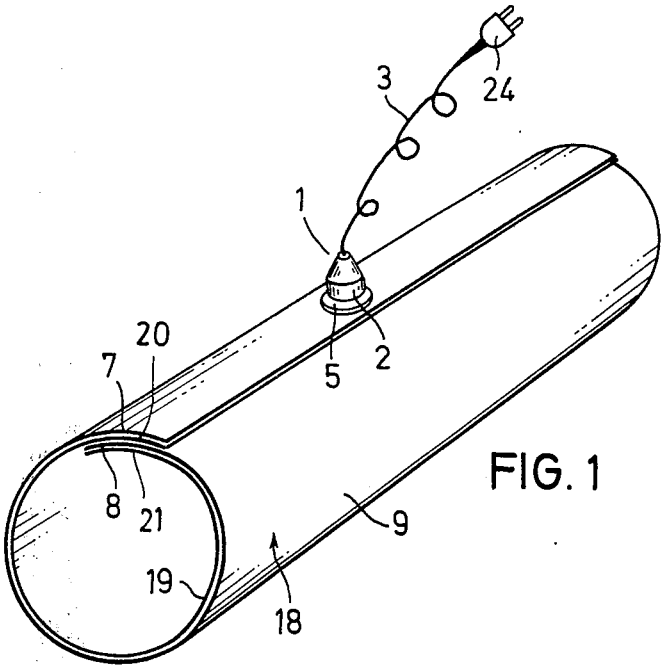
FIGS. 1–7 illustrate the invention by way of example with respect to exemplary embodiments, but without being limited to these embodiments.
Figure 3:
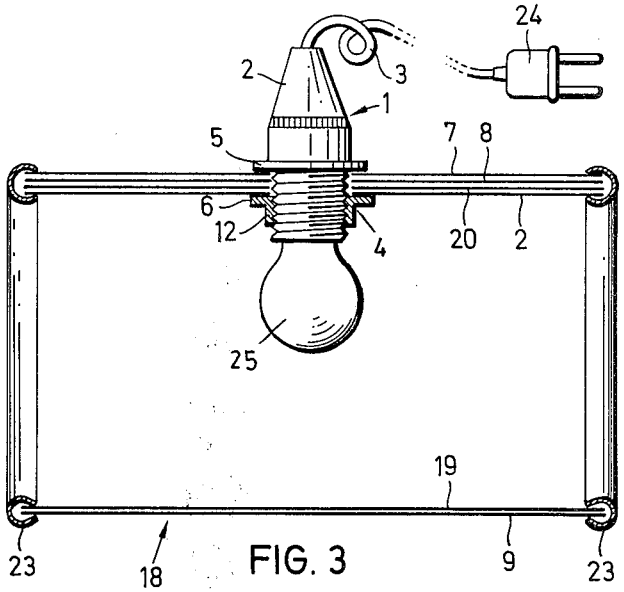
Figure 2:
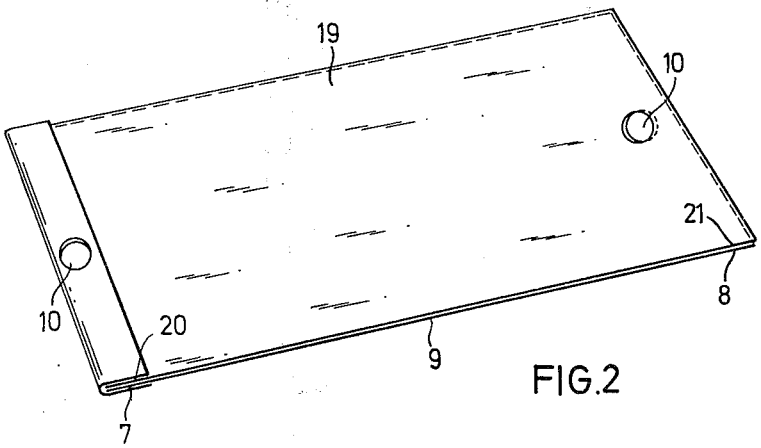
Figure 4:
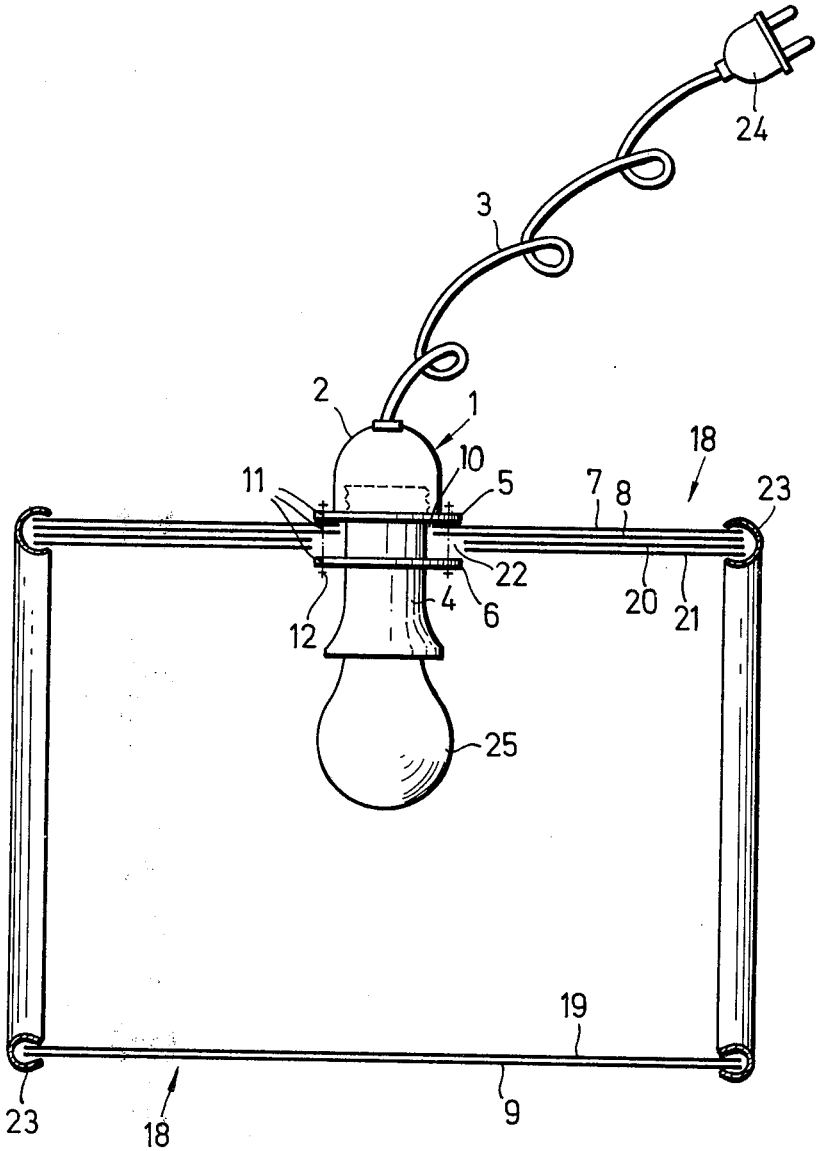

As shown in FIGS. 1–3, the cylindrical holder 18 consists of a bent first foil 9, the facing ends 7 and 8 of which overlap one another. A second foil having overlapping ends 20 and 21 is sprung into the first foil 9 having overlapping ends 7 and 8. The overlapping ends 20 and 21 of the second foil are located in the region over the overlapping ends 7 and 8 of the first foil 9. The holder 18 is provided in the region of the overlapping ends 7 and 8 of the first foil 9 respectively 20 and 21 of the second foil 19, preferably midway over the center of gravity of the holder 18, with cutouts 10 for the lamp socket 1. The lamp socket 1 is bipar tight. It consists of a cable part 2 which is placed onto the picture holder 18 at the exterior and the bulb part 4 which is located inside the holder 18. The lamp socket 1 as such and the cable part 2 as well as the bulb part 4 are produced in known per se manner and are not described because they do not belong to the invention. The cable part 2 is connected with the connecting cable 3 which carries the plug 24 at the end remote from the cable part 2. In a known manner the light bulb 25 is inserted into the bulb part 4. Cable part 2 and bulb part 4 of the lamp socket 1 are connected with one another, e.g. screwed together, in known manner. As a rule, only a screw thread for the base of the bulb 25 is provided in the bulb part 4, whereas the contacts are in the cable part 2. The juxtaposed ends of the cable part 2 and the bulb part 4 are each provided with a circumferential flange 5 respectively 6. The holder is bent from the first foil 9 and the second foil 19 in such a manner that the cutouts 10 and the overlapping ends 7 and 8 respectively 20 and 21 are in registry. Advantageously, the ends of the holder 18 which are remote from each other have rings 23 placed on them. These rings 23 are preferably of a U-shaped profile into the facing open sides of which the ends of the picture holder 18 are pushed and if desired clamped. The rings 23 are preferably produced of an elastic, e.g. metallic material. It has been found advantageous to make the rings 23 of synthetic plastic, particularly coated synthetic plastic. If the holder 18 of the first foil 9 and the second foil 19 has been bent and once the rings 23 have been put in place so that the holder 18 can no longer spring apart, then the usual lamp socket 1 is placed into the shade. In a conventional lamp socket 1, the cable part 2 and the bulb part 4 are already assembled by the manufacturer. The cable part 2 has a fixed flange 5, whereas the bulb part 2 has an external screw thread onto which a flange 6 is threaded. To assemble the holder 18 the flange 6 is unscrewed from the bulb part 4, the lamp socket 1 with the bulb part 4 is pushed from the exterior through the cutouts 10 in the first foil 9 and the second foil 19 until the flange 5 exteriorly abuts the first foil, and from the interior the flange 6 is then threaded onto the bulb part 4 until this flange 6 abuts the inside of the second foil 19. Thereupon the bulb 25 is screwed in. The edges of the cutouts 10, the cross-section of which corresponds to the end of the bulb part 4 which faces the cable part 2, are then clamped between the flanges 5 and 6. It can be advantageous to construct the cutouts 10 in the inner second foil 19 as cutouts 22 the cross-section of which corresponds to the outer diameter of the flange 6. The circumferential flange 6 then lies on the inner side of the one overlapping part 8 of the first foil 9 (FIG. 4). This embodiment has the advantage that, if desired after removal of the rings 23 and advantageously after the removal of the bulb 25, the inner second foil 19 can be squeezed together so that a gap develops between the inner second foil 19 and the outer first foil 9 and the pictures can be exchanged without having to unscrew the flange 6. In such an embodiment the overlapping ends of the two foils 9 and 19 may not be pushed into one another. The one end 8 of the first foil must abut the other end 7 and the one end 21 of the inner second foil 19 the other end 20. The first foil 9 and the second foil 19 are advantageously of an elastic material, preferably synthetic plastic. The outer first foil 9 should be of transparent material and the inner second foil 19 of translucent material.

FIG. 2 shows that the cutouts 10 in the second foil 19 and the first foil 9 do not register in flat overlapping relationship. The displacement of the inner second foil 19 and the outer first foil 9 during bending together is so substantial that in bent-together condition, due to the slightly different bending radius of the first foil 19 and the second foil 9, the cutouts 10 in the two foils move into registry. As FIG. 2 also shows, it is possible to connect the first foil 9 and the second foil 19 at one of their ends 7 and 20 or 8 and 21, particularly by means of a U-shaped connector 26.

Figure 5:
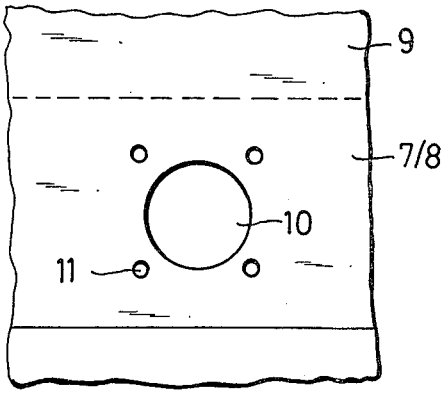

The embodiment according to FIGS. 4 and 5 corresponds essentially to the embodiment of FIGS. 1–3. The overlapping ends 7 and 8 of the first foil 9 and 20 and 21 of the second foil 19 are, however, provided in the region of the circumferential flanges 5 and 6 with two or more overlapping holes 11. Similar holes 11 are provided in the circumferential flanges 5 and 6. The lamp part 4 and the cable part 2 are inserted in such a manner that the cutouts 11 in the circumferential flanges 5, respectively 6, are located over respectively under the cutouts 11 in the overlapping parts 7 and 8, respectively, 20 and 21. Thereupon, the shafts of bolts 12 are passed through the cutouts 11 and secured by means of the associated nuts. A screw connection between cable part 2 and lamp part 4 is not absolutely necessary in this embodiment. Other connecting means can also be chosen. If desired it is possible to eliminate such connecting means completely, because cable part 2 and lamp part 4 are held together by the nuts 12. In this embodiment, it is moreover advantageous to fixedly connect the flanges 5 and 6 with the cable part 2, respectively, the lamp part 4. In this embodiment it is possible, as shown in FIG. 4 and already described with reference to FIG. 1, to construct the cutouts 10 in the inner second foil 19 as cutouts 22 having a cross-section corresponding to the outer diameter of the flange 6 at the lamp part 4.

Figure 6:
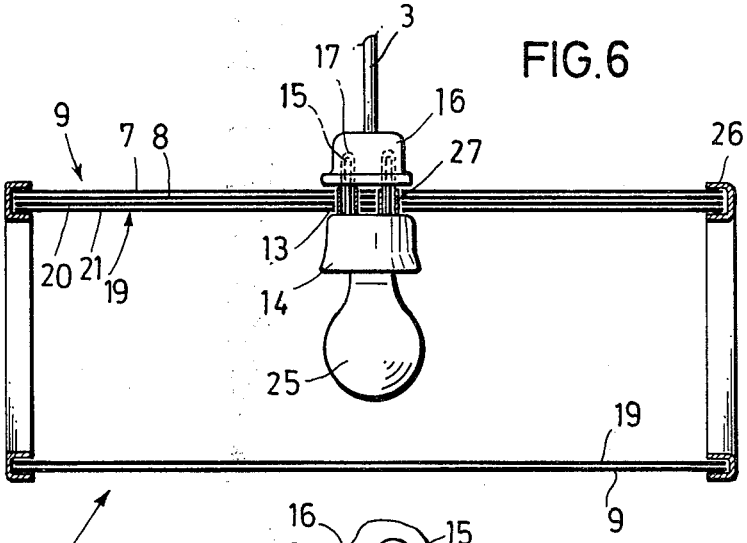
Figure 7:
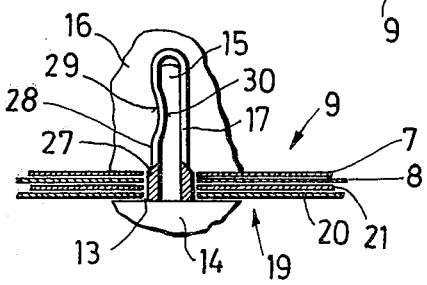

In the embodiment according to FIGS. 6 and 7 the holder 18 as such is constructed as in the embodiment of FIGS. 1–5. Differently constructed is the connection of the overlapping ends 7 and 8, respectively, 20 and 21 of the foils 9 and 19 with one another. The overlapping ends 7 and 8, respectively, 20 and 21 of the first foil 9 and the overlapping cutouts 13. Holder 18 has arranged under the cutouts 13 a lamp socket 14 with the bulb 25. This lamp socket 14 has provided on the side facing the foils 9 and 19 with two connecting pins 15. The connecting pins 15 extend into the recesses 17 of a socket 16 which is arranged at the outside of the holder 18. The socket 16 is provided in known manner with the cable 3 for connection to the current supply mat. This cable 3 is connected to the current supply mat in known manner, not illustrated. In the region of the overlapping ends 7 and 8, respectively, 20 and 21 of the foils 9 and 10 the connecting pins 15 have a layer 27 of insulating material. In place of the layer 27 of insulating material it is possible to provide collars on the socket 16 which surround the recesses 17. Naturally it is also possible to arrange the pins 15 on the socket 17 and the recesses 17 in the lamp socket 14. To prevent the connecting pins 15 from being undesirably pulled out of the recesses 17 it is advantageous to provide the wall 28 of the recesses 17 with a springy element 29 which engages in a depression 30 of the connecting pins 15. It is also possible to provide the connecting pins 15 with a springy element and the wall 28 of the recesses 17 with a depression.

It is possible to construct the U-shaped profiles as R-shaped profiles without departing from the concept of the invention. The two legs of the R-shaped profiles must each be freely movable independent of the other. Such a construction has the advantage that the foils can be pushed into the profiles in a much more simple manner.

SUMMARY

From German Gebrauchsmuster No. 76 40 586 a holder for translucent pictures is known which is bent from two transparent or translucent foils. The holder may be bent to the form of a cylindrical lamp shade. The facing ends of the foils are connected with one another. Between the two foils translucent pictures may be placed permanently but are yet exchangeable.

The connection of such a holder for translucent pictures is difficult because the bent-together ends of the foils must be connected with one another in a separate operation.

According to the invention it is proposed that the bent-together ends of the first foil and the second foil overlap one another and that the overlapping bent-together ends of the first and the second foil have registering cutouts through which means for connecting of the two ends are placed. The most advantageous means for connecting has been found to be a lamp socket.

I claim:

1. Holder for light-transmissive pictures, comprising: a first curved foil of elastic light-transmissive material; a second foil of elastic optical material sprung into the curvature of said first foil and abutting said first foil, the light-transmissive pictures being arranged between the first foil and the second foil; said first foil having bent-together ends; said second foil having bent-together ends overlapping the bent-together ends of said first foil; the bent-together ends of said first foil and of said second foil having overlying cutouts through which means for connecting said two ends are insertable.

2. Holder for light-transmissive pictures, comprising: a first curved foil of elastic light-transmissive material; a second foil of elastic optical material sprung into the curvature of said first foil and abutting said first foil, the light-transmissive pictures being arranged between the first foil and the second foil; said first foil having bent-together ends; said second foil having bent-together ends overlapping the bent-together ends of said first foil; the bent-together ends of said first foil and of said second foil having overlying cutouts through which means for connecting said two ends are insertable; said ends of the first foil and overlapping ends of said second foil having overlapping cutouts corresponding to the cross-section of a lamp socket, said lamp socket comprising a cable part with connecting cable and a bulb part, said cable part and bulb part having at their juxtaposed ends circumferential flanges between which the edge of the cutouts is clamped for connecting the overlapping ends of the two foils.

3. A holder as defined in claim 2, wherein one flange on the bulb part is a ring screwed onto the bulb part.

4. A holder as defined in claim 1, wherein the flanges and the overlapping ends of the foils have at least two overlapping holes through which bolts extend.

5. A holder as defined in claim 1, wherein cutouts for the lamp socket in overlapping ends of said second inner foil correspond in cross-section at least to the cross-section of the flange of a bulb part.

6. Holder for light-transmissive pictures, comprising: a first curved foil of elastic light-transmissive material; a second foil of elastic optical material sprung into the curvature of said first foil and abutting said first foil, the light-transmissive pictures being arranged between the first foil and the second foil; said first foil having bent-together ends; said second foil having bent-together ends overlapping the bent-together ends of said first foil; the bent-together ends of said first foil and of said second foil having overlying cutouts through which means for connecting said two ends are insertable; said ends of the first foil and said second foil having overlapping cutouts arranged in a number and at a spacing from one another corresponding to the number and spacing of connecting pins of a light connector, said holder having arranged beneath the cutouts a lamp socket with connecting pins, and a further socket at the exterior with connecting cable having recesses into which said connecting pins extend through the cutouts in the foils.

7. A holder as defined in claim 6, wherein said lamp socket has recesses and said further socket has connecting pins.

8. A holder as defined in claim 6, wherein said connecting pins have an insulating layer in the region of the second foil.

9. A holder as defined in claim 6, wherein said further socket of connector having recesses is located on a side facing said foils and has annular insulating collars extending through the foils.

10. A holder as defined in claim 6, wherein a wall of the recesses has a projecting springy element extending into a depression of the recesses.

11. A holder as defined in claim 1, wherein said first foil is of transparent material and said second foil is of translucent material.

12. A holder as defined in claim 1, wherein said first foil and said second foil are comprised of elastic material.

13. A holder as defined in claim 1, wherein opposite ends of the holder are bent from the first foil, said second foil having placed onto it rings of U-shaped profile into which lateral ends of the holder are inserted.

14. A holder as defined in claim 13, wherein said rings have a bent U-shaped profile with facing ends overlapping.

15. A holder as defined in claim 13, wherein said rings are of elastic material selected from the group of metallic material, synthetic plastic, and coated synthetic plastic.

16. A holder as defined in claim 1, wherein the first foil and the second foil are connected at one opposite end by a U-shaped connector of elastic material selected from the group of synthetic plastic, and coated synthetic plastic.

17. A holder as defined in claim 1, wherein spacing of the cutouts in said first foil is substantially larger than the spacing of the cutouts in said second foil.

* * * * *